US009517640B2

(12) United States Patent
Till

(10) Patent No.: US 9,517,640 B2
(45) Date of Patent: Dec. 13, 2016

(54) CYCLICALLY OPERATING PRINTING PRESS

(71) Applicant: Till GmbH, Kelkheim (Taunus) (DE)

(72) Inventor: Volker Till, Hofheim am Taunus (DE)

(73) Assignee: TILL GMBH, Kelkheim (Taunus) (DE)

( * ) Notice: Subject to any disclaimer, the term of this patent is extended or adjusted under 35 U.S.C. 154(b) by 0 days.

(21) Appl. No.: 15/027,706

(22) PCT Filed: Oct. 8, 2014

(86) PCT No.: PCT/EP2014/071552

§ 371 (c)(1),
(2) Date: Apr. 7, 2016

(87) PCT Pub. No.: WO2015/052240

PCT Pub. Date: Apr. 16, 2015

(65) Prior Publication Data

US 2016/0236483 A1 Aug. 18, 2016

(30) Foreign Application Priority Data

Oct. 8, 2013 (DE) ..... 10 2013 111 133
Jun. 18, 2014 (DE) ..... 10 2014 108 567

(51) Int. Cl.
*B41J 3/00* (2006.01)
*B41J 3/407* (2006.01)
*B41J 2/01* (2006.01)

(52) U.S. Cl.
CPC ..... *B41J 3/4073* (2013.01); *B41J 2/01* (2013.01)

(58) Field of Classification Search
CPC ..... B41J 3/4073
See application file for complete search history.

(56) References Cited

U.S. PATENT DOCUMENTS 6,769,357 B1 8/2004 Finan
2012/0017783 A1* 1/2012 Uptergrove ..... B41J 3/4073 101/38.1

FOREIGN PATENT DOCUMENTS

DE 102013208065 A1 7/2013
EP 1225053 A2 7/2002

* cited by examiner

*Primary Examiner* — Julian Huffman
(74) *Attorney, Agent, or Firm* — Leydig, Voit & Mayer, Ltd.

(57) ABSTRACT

A cyclically operating printing press includes a clocked wheel with a drivable holder for holding a three-dimensional object arranged thereon. A fixed print head is disposed in a printing station. An additional print head is disposed in the printing station at another location or side than the print head relative to the axis of rotation of the three-dimensional object in such a way that: no dirt emanating from the print head can fall down onto any other print head of the printing station as a result of gravity, the at least one additional print head can print the three-dimensional object simultaneously with the other print heads of the printing station, and none of the print heads is arranged in an interference contour formed by the holder and the three-dimensional object held therein being moved by the transport system.

10 Claims, 7 Drawing Sheets

CYCLICALLY OPERATING PRINTING PRESS

CROSS-REFERENCE TO PRIOR APPLICATIONS

This application is a U.S. National Phase Application under 35 U.S.C. §371 of International Application No. PCT/EP2014/071552, filed on Oct. 8, 2014, and claims benefit to German Patent Application Nos. DE 10 2013 111 133.5, filed on Oct. 8, 2013, and DE 10 2014 108 567.1, filed on Jun. 18, 2014. The International Application was published in German on Apr. 16, 2015 as WO 2015/052240 A1 under PCT Article 21(2).

FIELD

The invention relates to a cyclically operating printing press for printing three-dimensional objects by means of inkjet printing in at least one printing station with a transport system on which at least one drivable holder for holding a three-dimensional object is arranged. The transport system of the printing press can preferably be designed as a clocked wheel, which is rotated in cycles. In an embodiment, the invention can also be used with a linear drive transport system.

BACKGROUND

Printing presses for directly printing three-dimensional objects as e.g. bottles or cans are known, which print the surfaces of three-dimensional objects by means of drop-on-demand technology. This type of printing press is also encompassed by embodiments of the present invention.

These known printing presses or systems are in principle all constructed for higher performance so that they print the objects in a transport device, whose transport direction is substantially aligned horizontally in order to move objects from an intake, also called input, to a discharge, also called output. For rotation systems, this means that the rotational axis of such printing presses is vertical to a clocked wheel.

Many such systems operate in such a manner that the print heads with the object bracket, also called holder, are moved along during transport and the print occurs during transport.

However, other printing presses, called timing systems, are also known, in which the print heads are fixed and the objects to be printed are respectively cyclically successively driven under or in front of the print heads and are printed on their surface in a stationary manner, while the object to be printed is e.g. moved by rotation and thus rotates in front of a print head. The objects usually have a cylindrical shape in the region of the surface to be printed. These cylindrical objects are often arranged in the known printing presses with their symmetry axis horizontally, as the print heads were originally developed for flatbed printing. The cylindrical objects rotate under the print head about this horizontal rotation or symmetry axis, in order to have an image applied to them. This is shown in FIG. 1, which shows a printing press 201 with a clocked wheel 202, at whose circumferential edge the three-dimensional objects 203 are held horizontally via a holder so that the three-dimensional objects 203 may rotate under the fixedly arranged print heads 204. These print heads 204 each form a printing station 205 of the printing press 201. The clocked wheel 202 is actuated so that the objects 203 are respectively arranged in the printing stations 205 in a cycle position of the clocked wheel 202. The holders and the print heads 204 are arranged for this in a division corresponding to each other. This also applies in principle for the printing presses according to embodiments of the present invention.

The print direction illustrated in a part of the print heads 204 by lines between the print heads 204 and the objects 203 passes, as is usual with inkjet printers in flatbed printing, vertically from top to bottom, that is, with gravity. This arrangement is often also maintained when printing three-dimensional, in particular (in the printing region) cylindrical objects.

If e.g. cylindrical objects such as bottles or cans shall now be printed with such a printing press by rotation of the objects in front of the print heads, wherein the print image to be printed (in the direction of the rotational axis of the objects) is wider than the printing width of an ink jet head (which is defined by the linear arrangement of the print nozzles in the print head), the objects to be printed and the print head must be moved relative to one another in order to achieve greater printing widths.

However, this takes longer than the printing by rotating once about the axis of symmetry of the object, as a rotation of the object must take place in each relative position of the object and the print head. It is therefore attempted to print several sections of the image simultaneously by arranging several print heads. As the print heads need fixings and housing, a shock-free direct placement of two print heads next to each other is not possible so that the image can be printed smoothly. It is therefore necessary that the images are printed either in two successive printing stations, wherein the second part of the print of the desired print image then takes place in the following printing station. With even wider print images, two spaced-apart image parts can be printed in the first station. The free space between these two partial images of the preceding print head arrangement is then correspondingly printed in the following printing station. In principle, it would also be conceivable to arrange the print heads offset to each other in a printing station to arrange, as is done in a flatbed print. The offset print heads must thereby be aligned to the center of the rotational axis of the object in order to achieve a clean printing image.

The above-described arrangement of several print heads in a printing station is however disadvantageous when printing for example round or cylindrical three-dimensional objects. If such objects are moved along a transport direction in the printing press, they do not allow other parts of the printing press in the transport direction, unless these parts or objects are moved out of the transport plane during the transport. However, print heads cannot be accelerated or moved quickly, as the ink therein is otherwise ejected from the print nozzles and the important printing conditions change within the print head.

If one thus needs more than one print head for a desired print image for printing a surface, these print heads must be arranged either above a transport route or beneath a transport route, as the print head needs to be very close to the surface to be printed. Theoretically, the transport movement of the three-dimensional objects can also be designed so that it does not take place in only one plane, but the object is lifted after the cycle step and is guided to the print heads, or is lowered again before continuing the cycle. This does not only result in a loss of time for the lifting and lowering, but also in a much more complex mechanism and the risk, during movement in two planes, not to find exactly the point so that drop on drop is printed for a pixel of the print image. The results are blurred, qualitatively not high-quality print images.

The arrangement of a second print head below the transport plane is (in the illustration of FIG. 1) indeed theoretically possible. In practice, however, the problem exists that falling dirt particles and sprayed ink residues of the print head arranged above the transport plane immediately contaminate the print head arranged below the transport plane and, after a short time, this would not provide a clean print. Usually, with several colours or a wider print image, correspondingly more stations are provided on the press, in order to be able to arrange the print heads successively on several stations.

While this results in a lower mechanical effort in the printing press, it has the decisive disadvantage that the print image is not homogeneous. If images are printed that are made up of individual drops of for example different colour, the drops flow further apart after the impact on the surface. Thus, the right time between application and pinning or partial curing of the drops (for example by UV irradiation) must be found, so that the desired colour impression due to the surface covered after the flowing apart always remains the same. Such pinning processes are usually performed before the cycle transport step, as the transport step is connected with considerable acceleration, and the still low-viscosity aqueous ink can otherwise form drips by the inertia of the ink mass. At least an attempt is made to reduce the necessary cycle transport steps as far as possible. The respective colour layer could be printed cleanly in two steps and also pinned. Here, however, the fact is overlooked that exposed colour areas are pinned several times. The first of the colours applied in two steps is pinned twice, but the second one only once. The colour is no longer homogeneously the same for the following colour application, but it has two different properties through the different partial cure/the different pinning. These result in surface tension and adhesion of the subsequent colour.

Each additional curing changes the surface tension of a colour, and results, when subsequently printing with other colours, that these become either too hydrophilic or too hydrophobic. The drop of the colour to be applied later thus impinges a surface with different and not foreseen surface tensions and is thus not applied as reproducibly so that a good print image results. As UV colours cure by polymerization, it is important that they cross-link with the underlying colour layer. This is not ensured sufficiently if the underlying layer is already polymerized too much by two curing processes. The colours are then no longer cross-linked, but only lie on top of each other, which is reflected in reduced colour adhesion.

SUMMARY

In an embodiment, the present invention provides a cyclically operating printing press for printing three-dimensional objects by inkjet printing in at least one printing station. A transport system including a clocked wheel on which at least one drivable holder for holding a three-dimensional object is arranged is configured to rotate in a clocked manner. At least one fixed print head is disposed in the printing station and is not moved with the transport system for inkjet printing. A controller is configured to: position, via the transport system, the holder in the printing station in such a way that the three-dimensional object is held in front of the first print head, and rotate, via the holder, the three-dimensional object held in front of the first print head about an axis of rotation. At least one additional print head for inkjet printing is disposed in the printing station at another location or side than the print head relative to the axis of rotation of the three-dimensional object in such a way that: dirt emanating from the print head cannot fall down onto any other print head of the printing station as a result of gravity, the at least one additional print head can print the three-dimensional object simultaneously with the at least one print head, and none of the print heads is arranged in an interference contour formed by the holder and the three-dimensional object held therein being moved by the transport system. An axis of the clocked wheel is substantially horizontal and each holder of the three-dimensional object at each printing station always has a same axial orientation and is oriented in each case such that the axis of rotation of the holder is in the direction of gravity, so that the print heads print the three-dimensional object from the side.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
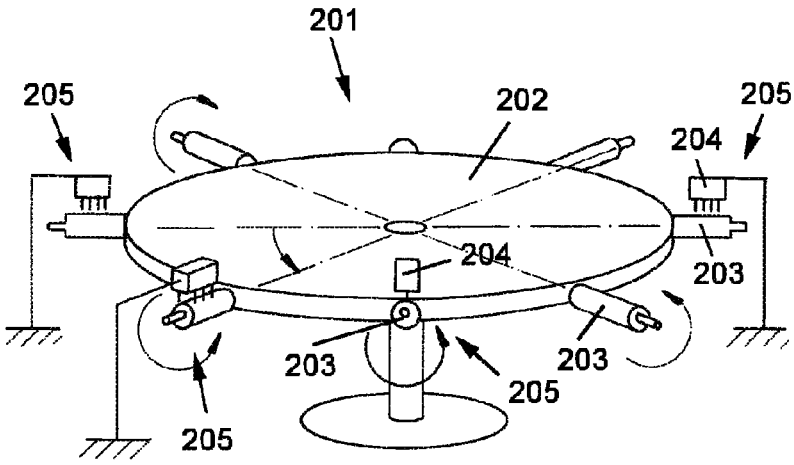
FIG. 1 a three-dimensional view of a cyclically operating printing press for printing three-dimensional objects according to the state of the art.

The printing press has at least one fixed print head in the or each printing station, that is, not moved together with the transport system, for the inkjet printing executed in particular as a digital print. Furthermore, a controller is provided, which is adapted, by means of the transport system, to position the holder or possibly several holders in the printing station, or possibly the several printing stations so that a three-dimensional object held in the holder is held in front of the print head, and to rotate a three-dimensional held in front of the print head for printing by means of the holder preferably having a rotary drive in front of the print head about a rotational axis. During this rotation of the three-dimensional object, the printing by the print head or the print heads actuated by the controller then takes place in a known manner.

The controller may in particular have a computing unit which, in a principally known manner, is arranged to implement the control steps provided according to embodiments of the invention, which will still be explained below, by program encoding means.

According to an embodiment of the invention, the three-dimensional objects to be printed are in particular bodies with a three-dimensional shape, which enclose an inner volume. These include in particular containers such as bottles made of plastic or glass or cans. Preferably, the object may be a rotationally symmetric body about an axis at least in the outer contour.

In an embodiment, the object is held in front of the print head for printing at a distance therefrom suitable for inkjet printing. The distance comprises a range of 1 mm up to preferably 5 mm, but at most up to a maximum of 20 mm. This is particularly valid for the particularly preferred embodiment of the invention, in which the three-dimensional objects are bottles or cans.

In an embodiment, the present invention provides a printing press of the above-mentioned type, which facilitates a high-quality print image for wider print images and/or multi-colour printing. Wider print images are thereby understood to be in particular print images that cannot be produced with a print head in one printing step with an object rotating in front of the print head.

In an embodiment, it is provided that the printing press in the at least one printing station has at least one further print head, which is arranged in such a manner at another location or side with regard to the rotational axis of the three-dimensional object that no dirt emanating from this print head can fall on any other print head of the printing station. In other words, the two or more print heads of a printing station of the printing press are not arranged below each other in the vertical direction defined by gravity, that is, the print nozzles of a print head do not point vertically downwards in the direction of another print head of the, in particular the same, printing station, so that no dirt falls directly from an upper print head into the nozzle region of a lower print head. Dirt emanating from a print head by gravity is in particular falling dirt particles and sprayed ink residues.

Further, the at least one further print head is arranged in such a manner that it can print the three-dimensional object simultaneously together with the other print head or the other print heads of the printing station. In other words, the at least one further print head is thus arranged in such a manner that the three-dimensional object is held in the print distance during the rotation in front of the other print head also for printing in front of the further print head or the several further print heads, so that the several print heads (at least two) can print simultaneously during rotation.

According to a further embodiment of the present invention it is provided that none of the print heads is arranged in the interference contour formed by the movement of the holder with a three-dimensional object held in the holder by means of the transport device. As a result, the transport system, which may in principle be designed as a clocked wheel, but also as a linear system, can move the three-dimensional object in the transport direction immediately after printing as well as optionally curing or pinning, if this is directly possible in the printing station, without causing collisions due to interference contours or the object and/or one or more print heads must be driven out from a interference contour.

In the case of further print heads, that is for a printing station with more than two print heads, this applies correspondingly for each print head of the printing station.

By means of the arrangement of multiple print heads outside the interference contour defined by the transport of the object proposed according to an embodiment of the invention, a high cycling of the printing press is possible. By means of the arrangement of the print heads in such a manner such that, within a print station, no dirt falls by gravity from an (upper) print head to a (lower) print head in its printing region defined by the printing nozzles, several print heads for generating wider and/or multi-colour print images can also be operated simultaneously. This leads to a more uniform print application and an improved print quality without the maintenance increasing due to possibly contaminated print heads. With multiple printing stations in the printing press, the individual printing stations can be protected by structural measures, as for example shields through plates or sheets, from dirt by gravity from other printing stations. Therefore, it is sufficient according to the invention, if the described type of the arrangement of the print heads respectively applies separately to each of the several printing stations. Of course, such an arrangement can particularly preferably also apply to print heads of different printing stations. In this case, structural shields between different printing stations (possibly at least partially) can be dispensed with. Such shields are often not possible within a printing station for space reasons.

According to one embodiment, the rotary drive can preferably have no axial adjustment of the holder in the direction of the rotational axis in order to position the three-dimensional object at different heights from the print head or to move from a transport position to a printing position in front of the print head. An axial adjustment possibility of the holder is not meant thereby. The rotational axis preferably corresponds to the symmetry axis of the rotationally symmetric, three-dimensional object.

A particularly preferred embodiment of the proposed, cyclically operating printing press may provide that the print heads along the transport route are arranged opposite to each other. This means that the print heads of a printing station or respective pairs of print heads of a printing station are arranged opposite each other with regard to the transport direction defined along the transport route of the objects. Seen in the transport direction, two print heads are thus respectively arranged opposite each other to the left and the right with regard to the to the transport direction, in order to lie safely outside the interference contour. According to an embodiment of the invention, the print nozzles of the print heads are thereby preferably aligned to each other in their printing direction, preferably so that a common printing plane is defined by the alignment of the print nozzles of both print heads. It is particularly advantageous according to an embodiment of the invention that an axis defined by the center between the pressure nozzles in the printing plane axis coincides with the rotational axis of the three-dimensional object during printing.

According to a preferred embodiment, the printing plane is aligned vertically to a tangent of the direction of movement, that is, with a linear direction of movement, to the direction of movement. In this way, a minimum distance between the opposed print heads is achieved without these print heads engaging the interference contour of the moved holder with the held object. The distance between the print heads or the print nozzles of the print heads preferably corresponds exactly to the diameter of the object to be printed plus the distance to each of the two print heads necessary for printing by means of inkjet printing, as was already defined initially. The total distance is thus calculated from the diameter of the object plus twice the distance between a print head and the object for printing.

Provided that the printing presses have several printing stations, or a printing station has a several print heads, the print heads may also be arranged in pairs within the frame of the above-described characteristic in such a manner that respectively different print head pairs are arranged spaced from each other in the transport direction. The print heads of a print head pair are respectively arranged opposite one another in the manner described. These print head pairs may be disposed in a printing station or also in several printing stations of the printing press along the transport direction.

According to a particularly preferred embodiment, the print heads arranged opposite each other are arranged in a displaceable manner by means of an adjusting mechanism in the radial direction with regard to the rotational axis of the rotary drive. The arrangement of the print heads can thereby be easily adapted to different diameters of the three-dimensional objects. The adjusting mechanism may thereby be designed in such a manner that both opposite print heads are adjusted synchronously at the same time in their distance to the rotational axis, for example by means of a linear displacement in opposite directions, which is simultaneously actuated by means of a gear drive. A separate adjustment is also possible.

A preferred specific embodiment provides that the print heads are positioned relative to the left and right to the direction of the three-dimensional objects fixed next to the transport system. This is particularly simple to implement structurally and achieves the advantages already described above.

In order to achieve a greater printing width of the print image on the three-dimensional object, print heads of a printing station can in particular be arranged to the left and right of the transport direction so that a print image on the three-dimensional object can be generated in the one printing station, whose width exceeds the width (or height) of a print head. In particular, the opposite print heads of the printing station are arranged offset thereto in the direction of the rotational axis of the rotary drive. By means of the two print heads together, the print height is increased in the direction of the rotational axis. Preferably, the opposite print heads are offset in this case so that their print regions defined by the print nozzles. An adjustment of the print heads thereby preferably takes place that print nozzles of the opposite print heads lying in the overlap regions are respectively arranged at the same height with regard to the axial direction of the rotational axis. This leads to a homogeneous print image whose height lying in the axial direction of the rotational axis is greater than the height of the print nozzles of a print head.

Alternatively or additionally it may be provided that several colours are printable or can be printed simultaneously in a printing station. For this, the different print heads of a printing station preferably have different print colours. When the print height in the axial direction of the rotational axis by a print head is sufficient, the opposite print heads can be mounted in the same axial height (and preferably adjusted) that the mutually corresponding print nozzles of the print heads are arranged at the same height. Then, each print head can print a colour by means of inkjet printing.

If, as described above, printing images with a print height (width) are to be generated in the axial direction which exceeds the print height (width) of a print head, two print heads may also be arranged below each other in the axial direction of the rotational axis. The print heads arranged opposite to these are then arranged vertically offset so that, opposite each other, respectively a pair of print heads of a colour is formed, whose print region overlaps in the manner described. A print image with two colours by print heads respectively arranged to the right and the left (with regard to the transport direction) can thereby be generated.

Alternatively, it is also conceivable to provide two printing positions, each with two oppositely arranged print heads, in a printing station and to form the holder for the bottle axially adjustable between the two printing positions. For this, the holder according to an embodiment of the invention is designed so that it does not exceed the diameter of the three-dimensional object in the radial direction with regard to the rotational axis. A height adjustment of the holder in front of the print heads is thereby possible without the interference contour generated by the height adjustment colliding with the print heads of the printing station in the different printing positions. However, the printing process takes longer.

According to an embodiment of the invention, in a further development of the proposed printing press, it can be provided to arrange, at each printing station of the transport system, in particular a clocked wheel to be described later in more detail, more than only one holder for the three-dimensional objects in the transport direction. Further, corresponding to the number of holders in the printing station, print heads are arranged in a multiple manner, preferably in each case opposite to each other. In each printing station, print heads are thereby arranged or attached to the right and left with regard to the transport direction, correspondingly for the respective multiple holders for the three-dimensional objects. The number of the three-dimensional objects printable in each cycle step of the transport system can be increased thereby.

According to an embodiment of the invention, the number of holders for three-dimensional objects at each printing position is also increased in this embodiment for increasing the performance of the cyclically operating printing press. In other words, not one holder is positioned in front of a set or pair of opposite print heads, but several, preferably three to four holders respectively form a printing station, in which respectively the corresponding same number of print head arrangements are positioned cyclically to the left and right of the three-dimensional object to be printed. This is possible both for linear transport systems as well as transport systems formed by clocked wheels. The latter may have a horizontal axis (shaft) with a vertical clocked wheel or a vertical axis (shaft) with a horizontal clocked wheel and object holders standing thereon. These embodiments are described in more detail later. The three-dimensional objects are passed to or inserted into respectively one station (similar to a printing station), preferably the same station.

According to an embodiment of the invention, the holder for the three-dimensional objects can have a bracket formed for example as a turntable with a rotary drive (motor) for rotation about the rotational axis and a centering element opposite to the bracket, wherein the three-dimensional objects are mounted and held or can be mounted or held on both sides by the bracket and the centering element. Preferably, the centering element can be designed so that it is located within the interference contour during a movement of the transport system, for example of the clocked wheel, and the rotation of the three-dimensional object. For this, the centering element can be held rotatably at a frame, also called adjusting mechanism, for the axial engagement and hold, which frame holds the centering element in an axially adjustable manner, wherein this frame (adjusting mechanism) is arranged in the transport direction in front of or behind the three-dimensional object. The frame guiding the centering element is thereby arranged within the interference contour formed by the holder with the object during a movement in the transport direction.

Although the characteristics described above could in principle be realized in a linear transport system, a particularly preferred embodiment of the invention relates to a cyclically operating printing press, in which the transport system is a wheel designated as clocked wheel, which is rotated cyclically and to which the at least one holder for the three-dimensional object is fixed. Such a clocked wheel is a particularly preferred embodiment, which achieves a high rate of objects to be printed in a limited space.

According to embodiments of the invention, two principal solutions are proposed for this.

A first embodiment with a clocked wheel provides that the axis of the clocked wheel is substantially designed in a vertical manner. In this case, the clocked wheel is thus aligned horizontally (with regard to gravity). In such an arrangement, it is preferred according to the invention that the holder with the rotational axis is arranged in the axial direction to the axis of the clocked wheel. In this arrangement, the print heads lying opposite each other can then be aligned according to the invention so that the printing direction of the print heads are designed vertically with regard to the transport direction and horizontally with regard to gravity. This arrangement reduces contaminations on the respective other print head or the respective other of print heads.

In this arrangement of a clocked wheel rotating cyclically about a vertical (vertical) axis, the holders (object holders) for three-dimensional objects as e.g. containers, bottles or cans, are thus arranged vertically on the clocked wheel. The print heads are fixed, thus, are not moving along, outside the interference contour of the three-dimensional objects as e.g. containers, bottles or cans, as well as within the interference contour. This is to be understood that the interference contour forms an annular ring in which the print heads are not arranged. A pair of oppositely arranged print heads then has a print head within the annular ring ("within the self-contained interference contour") and a print head outside the annular ring ("outside the self-contained interference contour"). The holders (object holders) themselves are equipped with a motor as a rotary drive, preferably a servo drive and an encoder, and can rotate the three-dimensional objects during the standstill of the clocked wheel in front of the print heads for printing.

In such a printing press with a horizontally arranged clocked wheel all print heads are vertical (with regard to gravity) and cannot be contaminated in this manner. In this arrangement, no print head lies in the printing direction below another print head of a printing station.

It is novel and inventive to arrange the print heads both internally and externally with regard to the self-contained interference contour, and namely in such a manner that they respectively have the same distance from the surface to be printed, wherein they are preferably also offset in the height to one another so that a complete, simultaneous, pixel-exact printing without free surfaces can take place over a height, which corresponds to the sum of the printing width (print height) of an individual print head. Preferably, all print heads shall be arranged movably in the direction of the center of the clocked wheel, that is, radially with regard to the clocked wheel, so that they can be adapted correspondingly to the respective diameter of the three-dimensional object to be printed. The print heads are no longer moved during the printing of several objects with the same diameter, and the objects can, without the print heads forming a interference contour for the movement of the object, be moved further by the clocked wheel.

The other, preferred variant provides that the axis of the clocked wheel is designed in a substantially horizontal manner. A particularly preferred arrangement is achieved hereby, in which the clocked wheel is vertical and which is particularly space-saving, as the space for the clocked wheel does not require the entire diameter of the clocked wheel, which extends in the height direction of the space. With holders and three-dimensional objects arranged in the radial direction of such a clocked wheel, in which the rotational axis of the holders is arranged in the radial direction of the clocked wheel, the holders with the three-dimensional objects thus describe a circular ring about the axis of the transport system. The opposite print heads are then aligned according to the invention so that the direction of printing of the print heads is formed vertically with regard to the transport direction and horizontally with regard to gravity. This arrangement can be handled in a structurally simple manner and reduces contaminations on the print heads.

In this arrangement of a cyclically rotating clocked wheel about a horizontal axis, the holders (object holder) for three-dimensional objects can thus preferably be formed radially at the clocked wheel. On the clocked wheel formed as a disk, the holders (object holder) for the three-dimensional objects are arranged radially, that is, in a spoke-like manner outwardly. The holders shall also be rotatable about their own axis and preferably be driven by a servo motor and preferably be provided with an encoder which indicates the trigger signal for triggering a print point or a print signal. The controller proposed according to the invention can perform this correspondingly with every described embodiment.

When the vertical clocked wheel rotates, a interference contour results for the arrangement of the print heads to the left and to the right next to the one-dimensional movement of the object to be printed. Both print heads to the left and to the right of the interference contours are not affected by falling dirt particles.

It is thereby enabled for the first time according to the invention to arrange several print heads to the left and/or to the right in such a manner that several print heads simultaneously print the object either with several colours in an overlapping manner or, with an offset arrangement, generate a self-contained print image in a printing station in such a manner that it is wider than the printing width of an individual print head, without resulting in the disadvantages of a different course of the printing ink due to a print on different printing stations or different surface tensions due to intermediate curing. Print errors due to contamination settling on the print heads due to gravity cannot occur.

This vertical arrangement of the clocked wheel can easily be adjusted to the different diameters of a cylindrical 3D object to be printed, as e.g. bottles or cans, as all print heads of all printing stations are arranged to the left and to the right. According to an embodiment of the invention, all print heads on the left shall preferably be mounted on a common disk, which is preferably mounted on the horizontal axis of the clocked wheel and which is designed in a displaceable manner in the axial direction. All print heads on the right shall correspondingly be mounted on a common disk preferably designed joint disc and also be displaced in the axial direction. Now, if three-dimensional objects printed with larger diameters, so you can move to the left and the right wheel to the right very easily all the print heads are adjusted simultaneously on the object to be printed or the diameter of the object by moving the left pane.

According to an embodiment of the invention, the object can further be centered and held by a centering element fulfilling the function of a counter holder, which is composed exclusively within the interference contour, and thus cannot come into collision with the print heads arranged next to the interference contour.

According to the invention, it is proposed in a preferred embodiment to carry out the printing on a clocked wheel which rotates about a horizontal axis. In this case, each holder of the three-dimensional object can be held rotatably at the clocked wheel about an axis, which is parallel to the axis of the clocked wheel. The rotational axis of the holder can thereby be aligned the same for each rotational position of the clocked wheel. With a desired alignment of the rotational axis in the direction of gravity, that is, a vertical alignment of the rotational axis, this can be achieved according to the invention in that the axis for holding the holder is arranged above the center of gravity of the holder and the axial direction of the rotational axis is arranged in an intersecting manner. The holder then always aligns solely by gravity so that the holder is aligned vertically. The axial mounting of the holder at the clocked wheel can possibly be damped in order to avoid an oscillation abound the axis.

According to an embodiment of the invention, instead of the above-mentioned free, that is, not driven, axis mounting, an axis mounting driven by the controller, for example by means of a motor drive, can be provided which is adapted to compensate for the respective cycled rotation of the clocked wheel by a counter-rotation. As the cycled rotation of the clocked wheel is known, this can take place by a controlled rotation of the axis mounting. Alternatively or additionally, sensors, such as rotational position sensors, gravity sensors, or the like, can also be used for controlling or regulating the rotation of the axis mounts.

In this case, holders (object holders) for the three-dimensional objects are thus arranged on the clocked wheel, for example, arranged regularly on the circumferential edge of the clocked wheel. The clocked wheel intermittently cycles corresponding to the division of the holders about its axis.

Each holder for a three-dimensional object can allow this to turn or rotate about its own axis, as already described in connection with the other embodiments, rotate through or rotate on its own axis. The drive (motor) for this rotational movement about the rotational axis can take place according to the invention either jointly for all holders via a gearing or the like, or alternatively separately at each holder by a suitable drive (motor). An encoder is assigned to each drive (motor), thus also alternatively to the joint ones with which encoder each position of the three-dimensional object is absolutely known during rotation, and which serves to trigger a print start signal.

According to an embodiment of the invention, it is further preferred that the holders are fixed to the clocked wheel so that they, during the rotation of the clocked wheel, are themselves rotated in opposite directions so that the three-dimensional objects are always in the same axial alignment to each other, thus e.g. all always horizontal or all always vertical (Paternoster principle). Furthermore, according to an embodiment of the invention, the axis of the three-dimensional objects as well as a plate of the or of one print head containing the print nozzles are principally aligned vertically or horizontally to the axis of the clocked wheel principally parallel to the clocked wheel.

Next to the clocked wheel, print heads are arranged in a stationary manner, and the clocked wheel cycles from printing station to printing station. It remains at the printing station for the duration of the respective treatment time, which in principle corresponds to the rotational period of the three-dimensional object in front of the print head or print heads. The print heads are thereby aligned in such a manner that they emit the drops not vertically downwards (in the direction of gravity), but preferably horizontally (printing direction). According to an embodiment of the invention, several print heads per printing station are thereby arranged so that they do not lie in the range of movement of the cycled rotated clocked wheel with the holders and the objects held therein (interference contour).

A simple input and/or output of three-dimensional objects to be printed into the clocked wheel or from the clocked wheel may take place according to an embodiment of the invention via an input star or an output star substantially vertical to the clocked wheel. This represents a constructively and easily operational input and output of objects to be printed into and out of the printing press.

Alternatively, the output of three-dimensional objects from the clocked wheel can take place by opening the holder and the falling down of the three-dimensional objects by gravity. The printed objects can then be collected in a collecting container and possibly be transport further from there. Such an output does not require a significant constructive effort and is particularly easy to handle.

Figure 2:
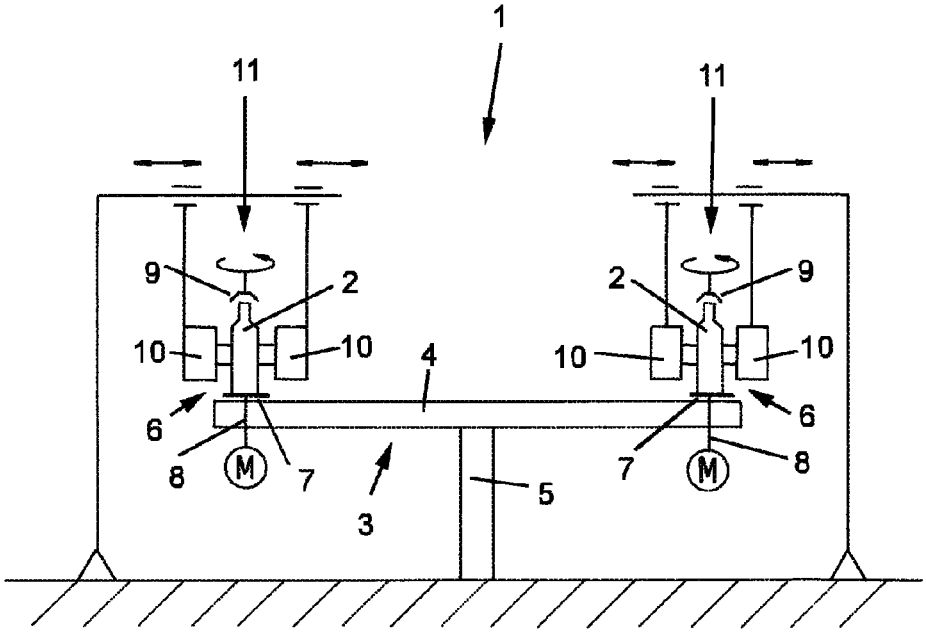
FIG. 2 a cyclically operating printing press according to a first embodiment of the present invention in side view.

Unlike the printing press 201 from the state of the art illustrated in FIG. 1, which has already been described in detail in the introduction, a cyclically operating printing press 1 shows according to FIG. 2 for printing three-dimensional objects 2, which has a clocked wheel 4 as a transport system 3 for the three-dimensional objects 2, which is rotatable about an axis 5 vertically upstanding on the base. Correspondingly, this embodiment is a printing press 1 with a substantially vertically running axis 5 of the clocked wheel 4.

In the region of the outer circumference of the clocked wheel 4, several drivable holders 6 are arranged in a distributed manner around the circumferential edge for respectively holding a three-dimensional object. The holder 6 has a bracket 7 which is designed in the shape of a turntable which is drivable about its rotational axis 8 by a motor 9 (in the sense of a rotary drive). The three-dimensional object 2 can be placed on the bracket 7 (disk). On the side opposite the bracket 7 (disk), the receptacle 6 has a centering element 9 which is likewise mounted rotatably about the rotational axis 8 and holds the three-dimensional object 2 in the receptacle 6 in a centering manner, in that it presses the three-dimensional object 2 against the support 7. By rotating the bracket 7 (disk), the three-dimensional object 2 rotates together with the centering element 9 about the rotational axis 8.

The printing press 1 further has fixed print heads 10 for the inkjet print, that is, not moved along with the transport system 3. The print heads 10 form a printing station 11 in which an object held on the holder 6 and rotating in front of the print heads 10 is printed.

Two such printing stations 11 are shown in the illustration according to FIG. 2. Further printing stations 11 are arranged around the circumferential edge of the clocked wheel 4. Their arrangement according to a preferred embodiment can be taken from FIG. 3.

Furthermore, the printing press 1 has a controller which is adapted to position the holders 6 by means of the transport system 7 in the printing stations 11 in such a manner that an object 2 is held in the holder is held in front of the print heads 10. In this position, the controller is further adapted to rotate the holders 6 by the motor 6 M about the rotation axis 8, so that the three-dimensional object 2 held in front of the print heads for printing rotates about the rotational axis. During the rotation of the object 2, ink is printed on the surface of the object 2 by the print heads 10 according to the rotational position of the object 2 in front of the print heads 10 in order to generate the image. Thereby, the print heads 10 of a printing station 11 can for example have different colours in order to generate a multi-colour print on the three-dimensional object 2. A corresponding function of the controller is provided in all described embodiments.

The two print heads 10 of a printing station 11 are arranged opposite each other in the radial direction of the clocked wheel 4, wherein the printing direction of the two print heads 10 is aligned toward each other. This is indicated in FIG. 2 by the horizontal dashes between the print heads 10 and the three-dimensional object 2. The first of the two print heads 10 is located in a radial region between the axis 5 of the clocked wheel 4 and the object 2. The other one of the two print heads of the printing station 11 is located in the radial direction outside the region between the axis 5 of the clocked wheel and the three-dimensional object 2. Thus, each of the two print heads 10 is arranged at a different location or side with regard to the rotational axis 8 of the three-dimensional object in such a manner that no dirt emanating from a print head 10, for example in the form of ink dried at the print nozzle, can fall onto the other print head 10 of the printing station 11 by means of gravity.

Furthermore, each print head 10 is arranged so that both print heads 10 can print the three-dimensional object 2 simultaneously, that is, respectively together with the other print head 10 of the printing station 11, as ink ejected from one print head 10 does not directly reach the other print head 10 due to the object 2 arranged between the two print heads 10, and contaminates this. Furthermore, the print heads 10 are arranged so that none of the print heads 10 are arranged in the interference contour formed by the movement of the holder 6 with the three-dimensional object 2 held in the holder 6 by the clocked wheel 4 of the transport device 3. In the illustration according to FIG. 2, one of the two objects 2 moves out of the image plane, while the other of the two illustrated objects 2 moves into the image plane. The interference contour formed by the holder 6 with the objects 2 thus corresponds to a hollow cylinder or a circular ring around the rotational axis 5. This is illustrated schematically in FIG. 3 by the outer circumferential edge of the clocked wheel 4 and the dotted circle 12. The circular interference contour 13 thus lies between the dotted circle 12 and the outer circumference of the clocked wheel 4. The print heads 10 of each of the printing stations 11 are arranged outside this interference contour 13. With regard to the direction of movement of the three-dimensional objects 2 tangentially along the center of the interference contour 13, the print heads 10 of the printing stations 11 are thus located to the right and to the left with regard to the direction of movement of the objects 2. This direction is also called transport direction.

The transport system 3 can thereby be rotated further with the clocked wheel 4, without having to move the print heads 10 of the printing stations in order to avoid the holder 6 and/or the object 2 held therein. The same applies to all described embodiments.

All the same, it is advantageous to design the print heads 10 in the radial direction of the clocked wheel 4 in a movable manner, so that the print distance of the print heads 10 to the three-dimensional objects 2 can be adjusted and the distance of the print heads 10 for objects 2 with a larger diameter can be adapted correspondingly. This is indicated by the double arrows in FIGS. 2 and 3.

Figure 3:
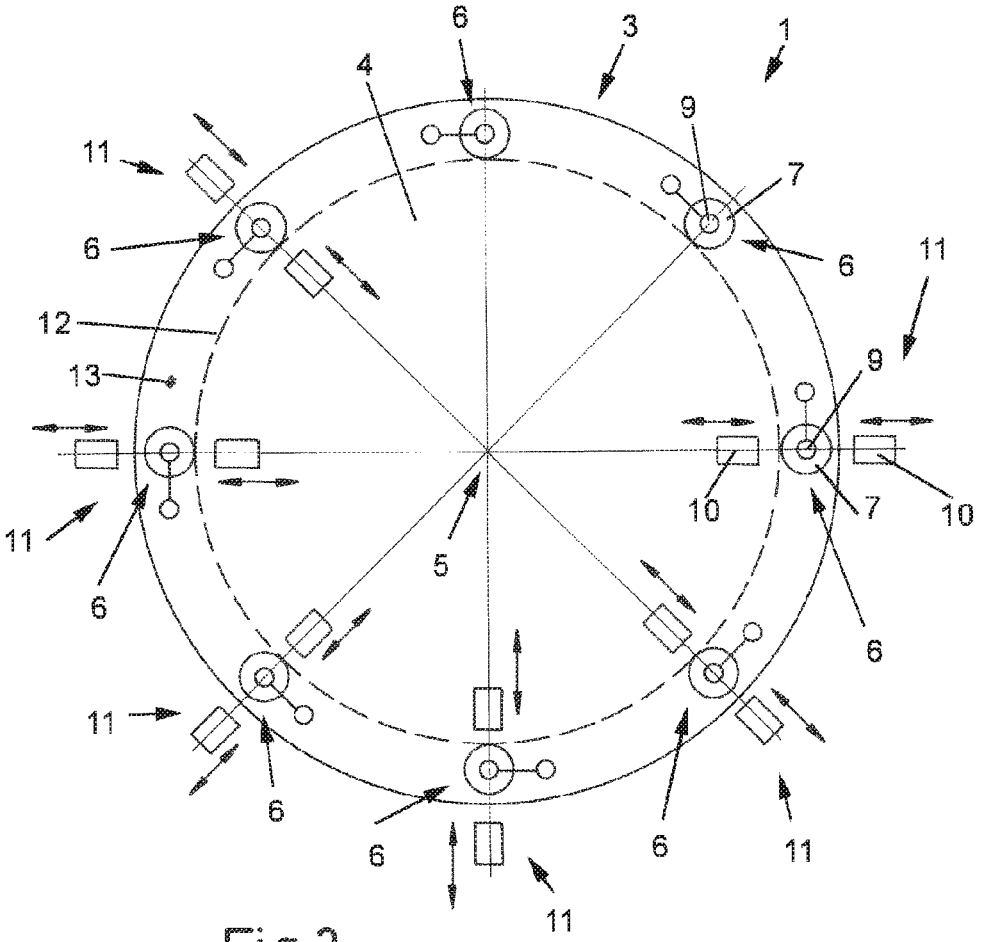
FIG. 3 the printing press according to FIG. 2 in a view from above.

From FIG. 3 it can be seen that the holders 6 are arranged equidistantly, that is, with the same radian measure, about the circumferential edge of the clocked wheel 4. Apart from two holders 6, a printing station 11 with two print heads 10 is provided for each holder 6. With the altogether illustrated eight holders 6, six three-dimensional objects 2 can thus be printed simultaneously in each cycle position. The two holders 6 not provided with print heads 10 thereby represent the positions for the input or output of the three-dimensional objects 2 on the clocked wheel 4 or the holder 6 of the printing press 1.

Figure 4:
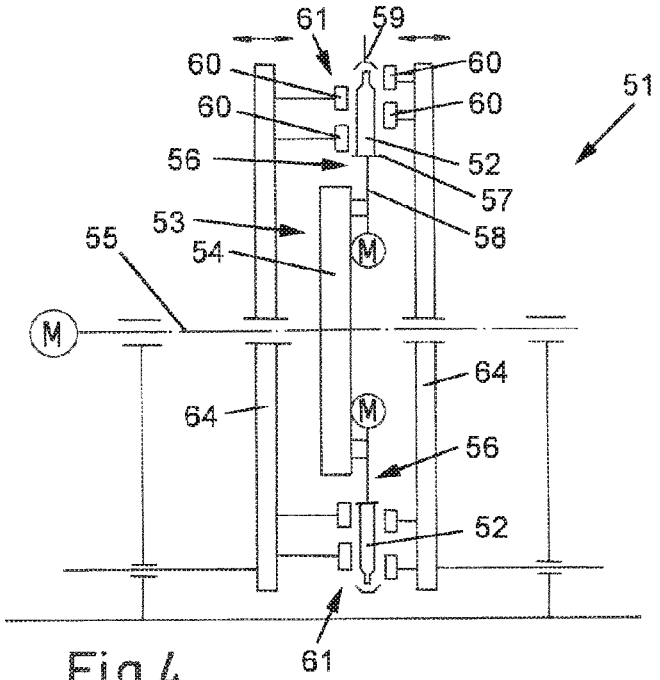
FIG. 4 a cyclically operating printing press according to a second embodiment of the present invention in side view.
Figure 5:
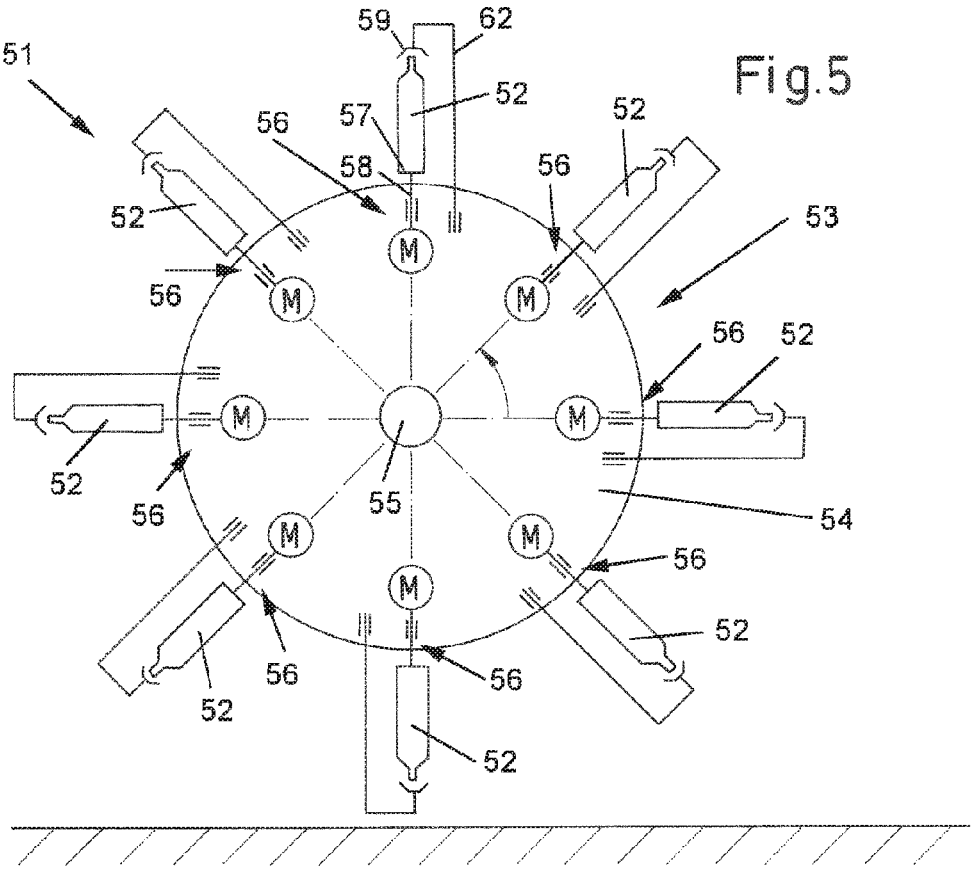
FIG. 5 the printing press according to FIG. 4 in a side view rotated by 90°.

In FIGS. 4 and 5, a second embodiment of a printing press according to the invention 51 for printing two-dimensional objects 52 is illustrated, which is constructed principally similar to the previously described printing press 1 and which is also designed as a cyclically operating printing press.

The printing press 51 has, as a transport system 53, a clocked wheel 54, which can be rotated about a horizontally mounted axis 55. At the circumferential edge of the clocked wheel 54, a holder 56 is provided for holding the three-dimensional object 52, which has a bracket 37 formed as a disk, which can be rotated about a rotational axis 58 by an electric motor M. On the bracket 57 (disk), the three-dimensional object 52 is received and fixed relative to the bracket 57 via a centering element 59. The structure and operation of the holder 56 thus corresponds to that of the holder 6 (see FIGS. 2 and 3), which has already been described in detail, so that a further description can be dispensed with at this point.

However, the alignment of the holder 56 differs from the alignment of the holder 6. The holder 56 is fixed to the clocked wheel 54 in such a manner that the rotational axis 58 of the holder 56 extends radially to the clocked wheel 54 and is vertical to the horizontally aligned axis 55 of the clocked wheel 54, wherein the holder 56 with the bracket 57 and the centering element 59 protrudes radially beyond the outer circumference of the clocked wheel 54.

Similar to the previous embodiment according to FIGS. 2 and 3, print heads 60 are arranged around the circumferential edge of the three-dimensional object 52 rotatable in the holder 56 in such a manner that the surface of the three-dimensional object 52 rotating past the print heads 60 can be printed, when the clocked wheel 54 is in a printing position, in which the object 52 received in the holder 56 is positioned with the desired printing distance in front of the print heads 60, and rotates in front of these.

The fixed print heads 60 of the printing press 51 respectively form the printing stations 61 of the printing press 51.

Similar to the previously described embodiment of the printing press 1, the print heads 60 are arranged opposite each other with regard to the direction of movement of the three-dimensional objects 52 in the holders 56 of the clocked wheel to the right and left of the direction of movement arranged in such a manner that an object 52 arranged in the printing station 61 in front of the print heads can be printed simultaneously by all four print heads 60 of the one printing station 61. The printing direction of the print heads 60 is again aligned horizontally, so that no print head 60 is arranged in the printing direction below another print head 60 in a printing station 61 by gravity. A contamination of the print heads 60 through spray mist or from ink deposits falling from the print nozzles of a print head is prevented hereby.

In the example illustrated in FIG. 4, the printing press 51 comprises altogether four print heads, two of which are arranged opposite one another respectively, wherein the opposite print heads 60 with regard to the axial direction of the rotational axis 58 are arranged at different heights, so that the printing regions of the opposite print heads overlap. This makes it possible to print, through the two opposite print heads 60, images on the three-dimensional object 52 that are greater in their print height than the length of a print head 60 in the axial direction of the rotational axis 58. The print heads 60 arranged below each other in the axial direction, which respectively have a horizontal print direction with regard to gravity in the illustration according to FIG. 4, can have different colours. In order to be able to address the different colours, the holder 56 according to FIG. 4 can for example, be designed to be adjustable in height in the axial direction, so that both print heights can be printed successively. Alternatively, the print heads, unlike as suggested by the sketchy illustration according to FIG. 4, also be arranged in such a manner that all four print heads have a common overlapping region, in which a two-colour printing in at one height of the holder is possible in the axial direction.

The print heads 60 of each of the printing stations 61 are fixed to two opposite print head holders 64, which are respectively arranged, seen in the transport direction of the three-dimensional objects, to the right and left of the clocked wheel 54 with the holders 56, so that the print heads 60 are respectively held in a printing distance to the objects 52 received in the holders 56. These print head holders 64 are designed as plates which are arranged parallel to the clocked wheel 54 and which are displaceable axially along the axis 55 of the clocked wheel 54 in order to adjust the distance of the print heads 60 to the three-dimensional object 53 in the holder 56. By the axial displacement of the two print head holders 64, the printing station can also be adjusted for printing three-dimensional objects 52 with different diameters.

As can be seen in FIG. 4, the illustrated three-dimensional objects 52 move about the axis 55 of the clocked wheel 54 from the image plane or into this on rotation of the clocked wheel 54. A interference contour of the holders 56 with the three-dimensional objects 52 received therein results thereby in such a manner that the illustrated print heads 60 are arranged outside this interference contour, namely to the right and the left of the interference contour with regard to the direction of movement of the three-dimensional objects 52. For this, the bracket (adjusting mechanism) of the centering 59 is also received in the region of the interference contour of the three-dimensional object 52 in such a manner that the centering 59 including the bracket (adjusting mechanism) does not protrude from the interference contour of the bracket 57 and the three-dimensional object 52. This can be seen in FIG. 5 from the side view of the printing press 51 rotated by 90°, in which the printing stations 61 with the print heads 60 are not shown for clarity. These lie above and below the plane of the drawing in the illustration of FIG. 5.

The disks or the brackets 57 of the holder 56 are driven directly by an axial motor M as a rotary drive at the rotational axis 58. The centering elements 59 are rotatably mounted in a linkage 62 which is held in the direction of the rotational axis 58 axially adjustable on the clocked wheel 54 (adjusting mechanism or bracket of the centering element 59).

Figure 6:
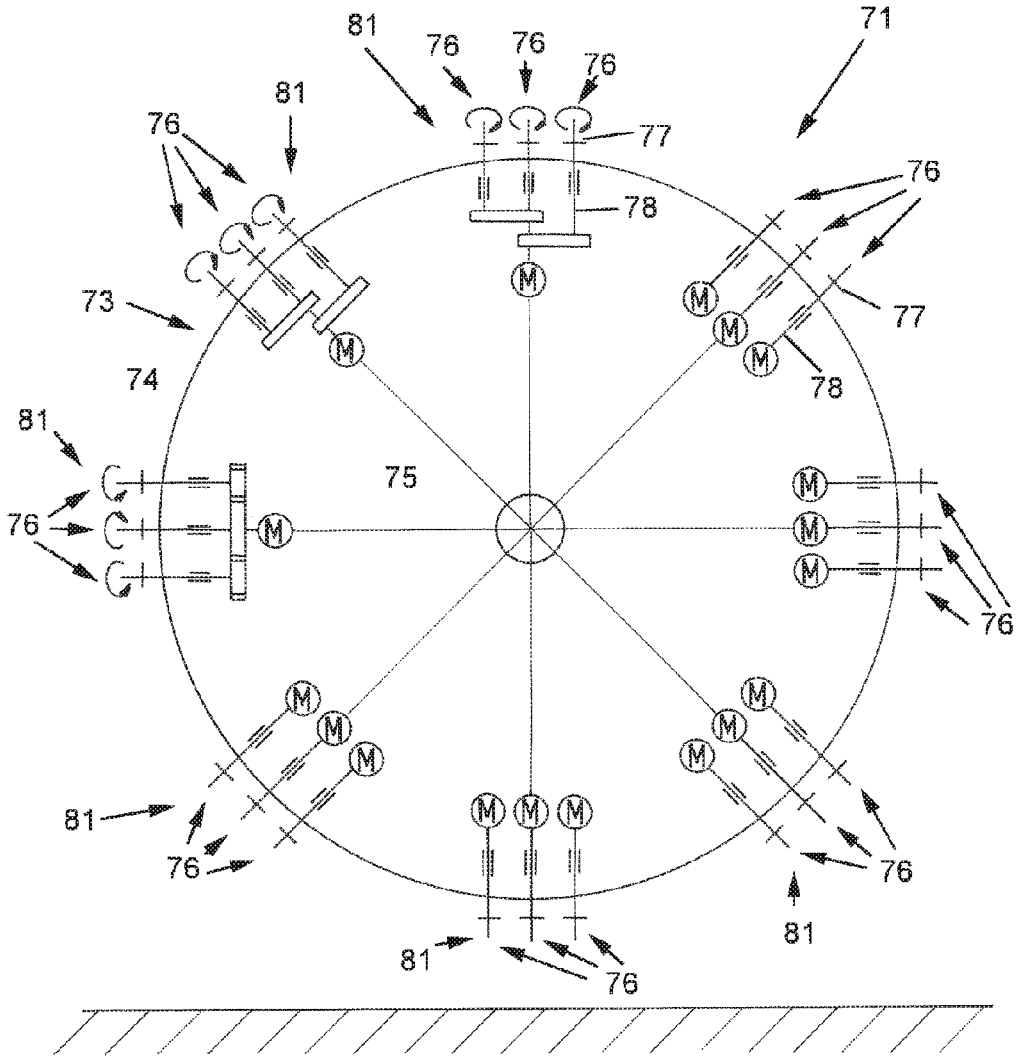
FIG. 6 a variant printing press according to FIGS. 4 and 5 in a side view comparable to FIG. 5.

FIG. 6 schematically shows a variant as a printing press 71, which is principally constructed the same as the printing press 51 described above. However, the printing press 71 has three holders 76 at each printing station 81 substantially arranged in parallel for holding a three-dimensional object, which are principally constructed the same as each of the holders 56 of the printing press 51. Correspondingly, each printing station 81 for each holder 76 has print heads arranged opposite each other, which respectively can print an object 2 received in the printing station 81, as described previously with regard to the printing press 51. By means of this type of arrangement, the number of printable objects 2 is increased with the same cycle of the clocked wheel.

Figure 7:
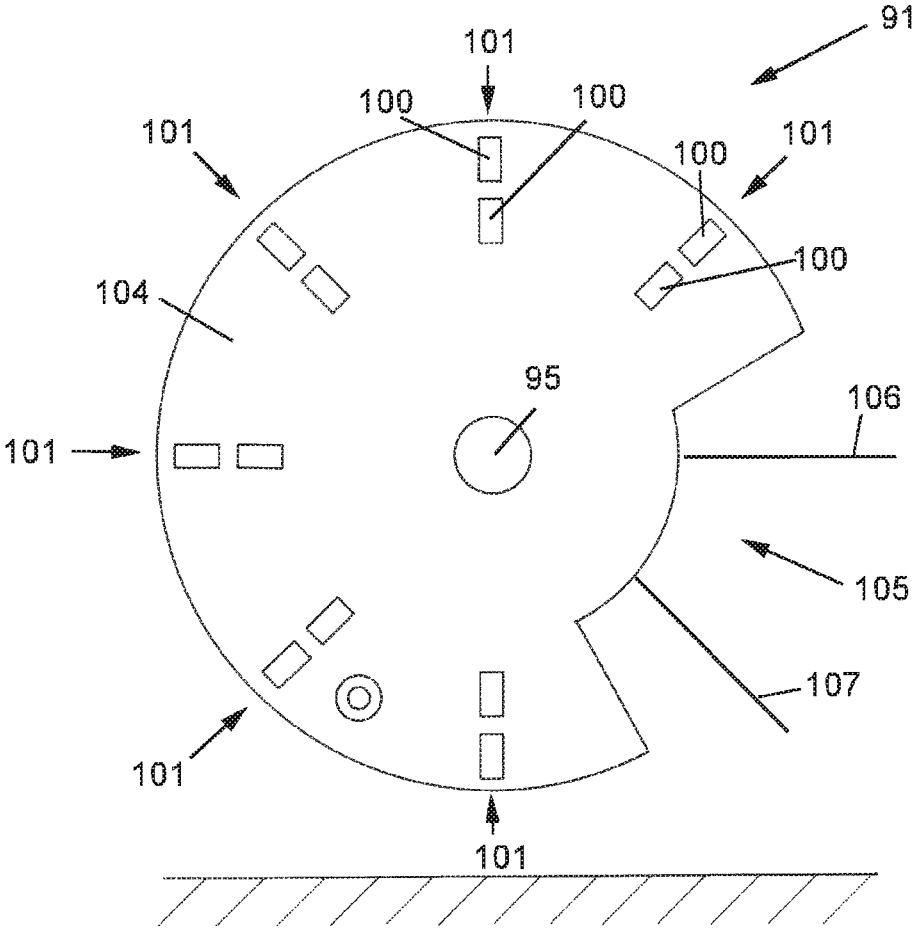
FIG. 7 a variant of the cyclically operating printing press according to FIGS. 4 and 5 in a side view comparable to FIG. 5.
Figure 8:
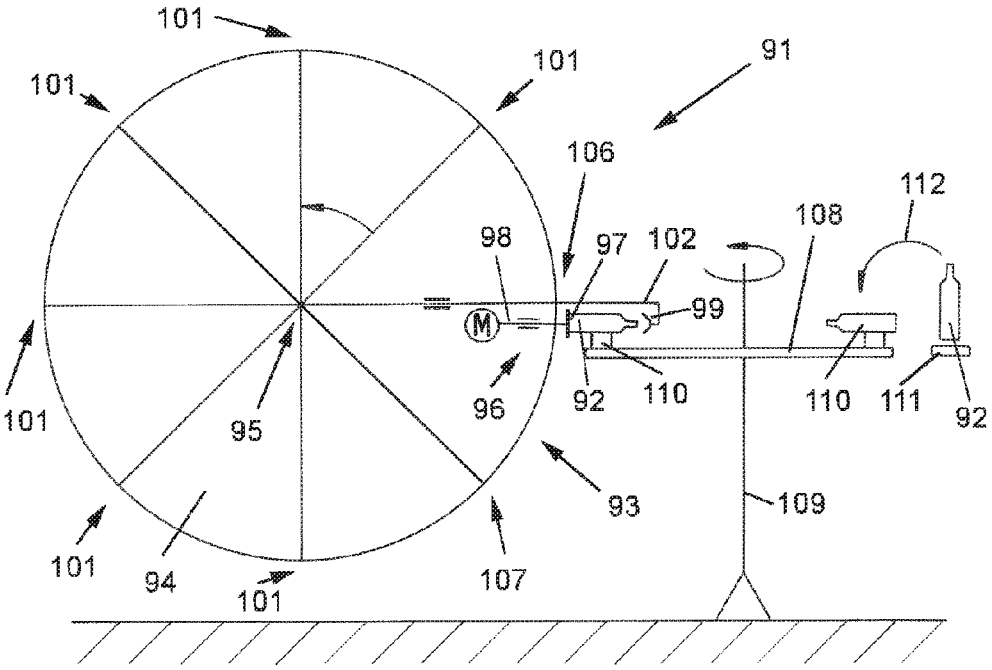
FIG. 8 a system for inputting three-dimensional objects into a printing press according to FIG. 7.

In FIG. 7, a further printing press 91 is shown schematically according to a fourth embodiment of the invention, which is, in its basic arrangement, similar to the printing press according to FIGS. 4 and 5, formed with a vertically standing clocked wheel 94. The clocked wheel 94 of the printing press 91 is illustrated in FIGS. 8 and 9.

Figure 9:
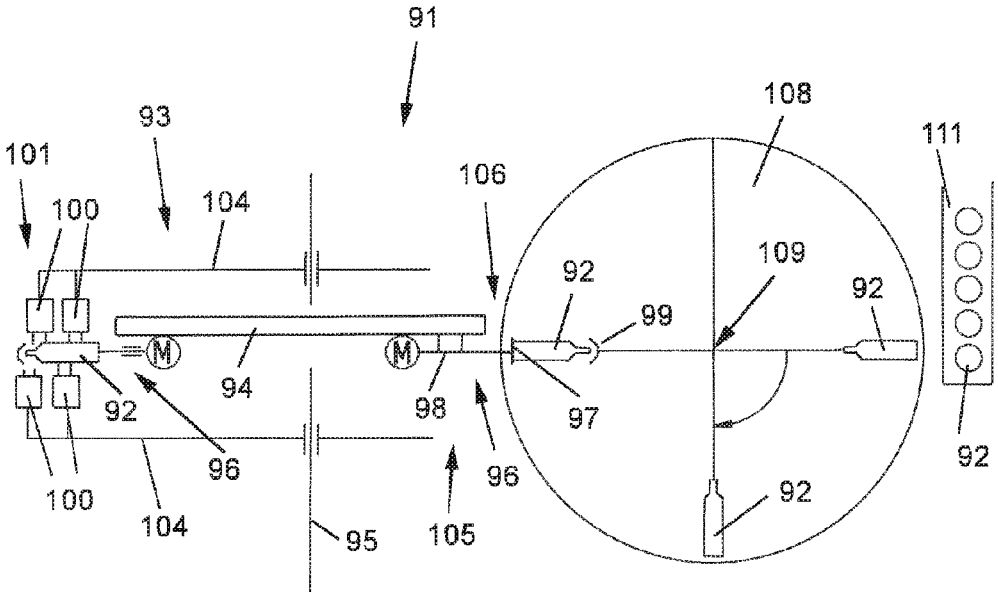
FIG. 9 a top view of a system according to FIG. 8 in a top view from above.

In FIG. 7, the print head holder 104 is illustrated, which in each case has two print heads 100 opposite each other in such a manner, that, between the opposite print heads 100 on the print head holder 104, the three-dimensional objects 92, such as shown in FIG. 9, are carried out or are held for printing in the holder 96 in a rotating manner in front of the print heads 100. In the center of the disk forming the print head holder 104 is provided a passage for mounting on the axis 95 of the clocked wheel 94.

The particularity of the printing press 91 is a recess 105 of the print head holder 104 in the region of the input 106 of the three-dimensional object 92 and the output 107 of the three-dimensional object 92. This recess 105 allows, as explained in the following with reference to FIGS. 8 and 9, a simple input of three-dimensional objects into the printing press 91. This is illustrated in FIG. 8 in the side view illustrating the clocked wheel 94 not shown in FIG. 7 with a holder 96 for holding the three-dimensional object 92 in the region of the input 106. In the output 107 as well as at the printing stations 101, the holders 96 are not shown for clarity. In the image plane in front of and behind the clocked wheel 94, the print head holder 104 with the print heads 100 in the region of the printing stations 101 and the recess 105 in the region of the input 106 and the output 107 of the three-dimensional object 92 is located on the axis of the clocked wheel mounted in a coaxial manner. This arrangement can be seen in FIG. 9. In FIG. 8, the print head holders 104 with the parts fixed thereto are not shown in each case.

The holder 96 is arranged on the clocked wheel 94 comparable to the holder 56 on the clocked wheel 54 according to the embodiment illustrated in FIGS. 5 and 6. This has, in a comparable manner, a bracket for the three-dimensional object 92 formed as a disk 97, wherein the bracket 97 can be rotated about the rotational axis 98 via a rotational axis 98 by a motor M (rotary drive). Opposite the bracket 97 formed as a disk, a centering element 99 is provided, which can be adjusted via a linkage in the direction of the rotational axis of rotation 98.

In the region of the input 106, an input star 109 formed as a rotating wheel is provided for inputting the three-dimensional objects 92, which star is aligned substantially vertical to the clocked wheel 94. In the illustrated embodiment of the printing press 91, the clocked wheel 94 stands vertically (relative to the direction of gravity). In other words, the rotational axis 98 is arranged horizontally. Correspondingly, the input star 108 aligned vertically thereto is aligned horizontally or horizontally (with regard to the direction of gravity), and has a vertical star axis 109, which carries the input star 108 on the base.

The height of the input star 108 is adjusted in such a manner that an object 92 held in an object mounting 110 of the input star 108 object 92 is just at the height at which a receptacle 96 of the clocked wheel 94 is in the position of the input 6, so that the three-dimensional object 92 can be positioned between the bracket 97 designed as a disk and the centering element 99 by means of the input star 108. In this position, the centering element 99 can comprise the three-dimensional object 92 and press against the bracket 97 (disk) of the holder 96 by an axial movement in the direction of the rotational axis 98. The three-dimensional object 92 is hereby inputted to the cycle wheel 94 of the printing press 91.

As can be seen in FIG. 9, several object mountings 110 are arranged in distributed over the circumference of the input star 109, wherein the arrangement and the division of the object mountings 110 may be adapted by the expert corresponding to requirements.

The feeding to the input star 108 can for example take place by a linear conveyor 111 by means of a suitable, known per se, feeder device 112, which is shown in FIG. 8 as an arrow for simplicity. FIG. 9 shows the printing press 91 in a plan view from above with the linear conveyor 111, the input star 108, as well as two holders 96 for holding the three-dimensional object 92, wherein one of the holders 96 is arranged in the input 106 of the three-dimensional object 92 and the other holder 96 is in a printing station 101. It can be seen in the region of the input 106 that, by the recess 105 of the print head holder 104 (or the print head holders 102 arranged on both sides of the clocked wheel 94), the clocked wheel 94 protrudes laterally with the receptacle 96 in the direction of the input star 108, so that the input star 108 does not collide with the print head holders 104.

The output 107 of the three-dimensional objects 92 can in principle be performed via an output star formed in a comparable manner to the input star.

An alternative possibility provides in the region of the output 107 of the three-dimensional object 92 that in the output 107, the centering element 99 of the holder 96 is moved away from the bracket 97 (disk), so that the object 92 falls from the holder 96 due to gravity and is collected in a suitable container or a suitable guide after printing.

Figure 11:
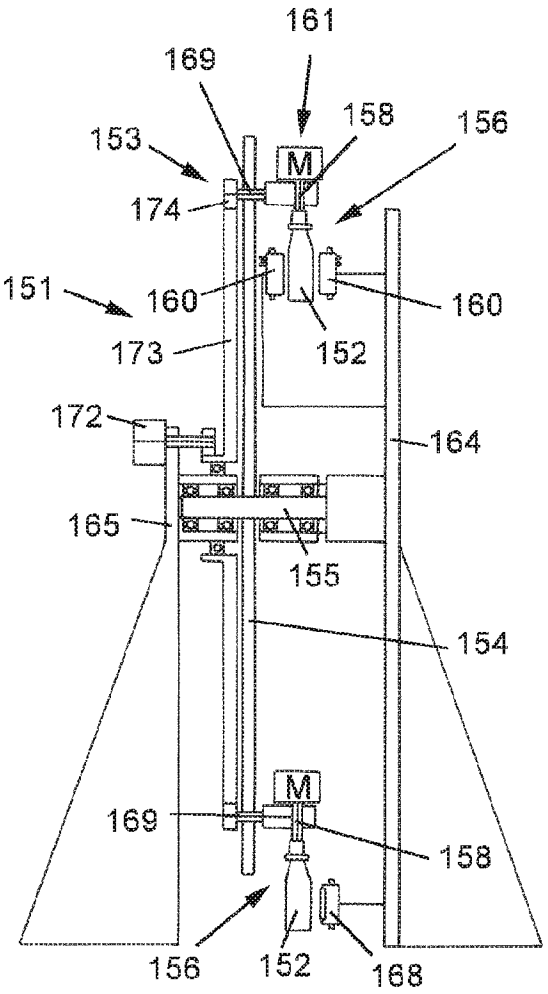
FIG. 11 the printing press according to FIG. 10 in a side view rotated by 90°.
Figure 10:
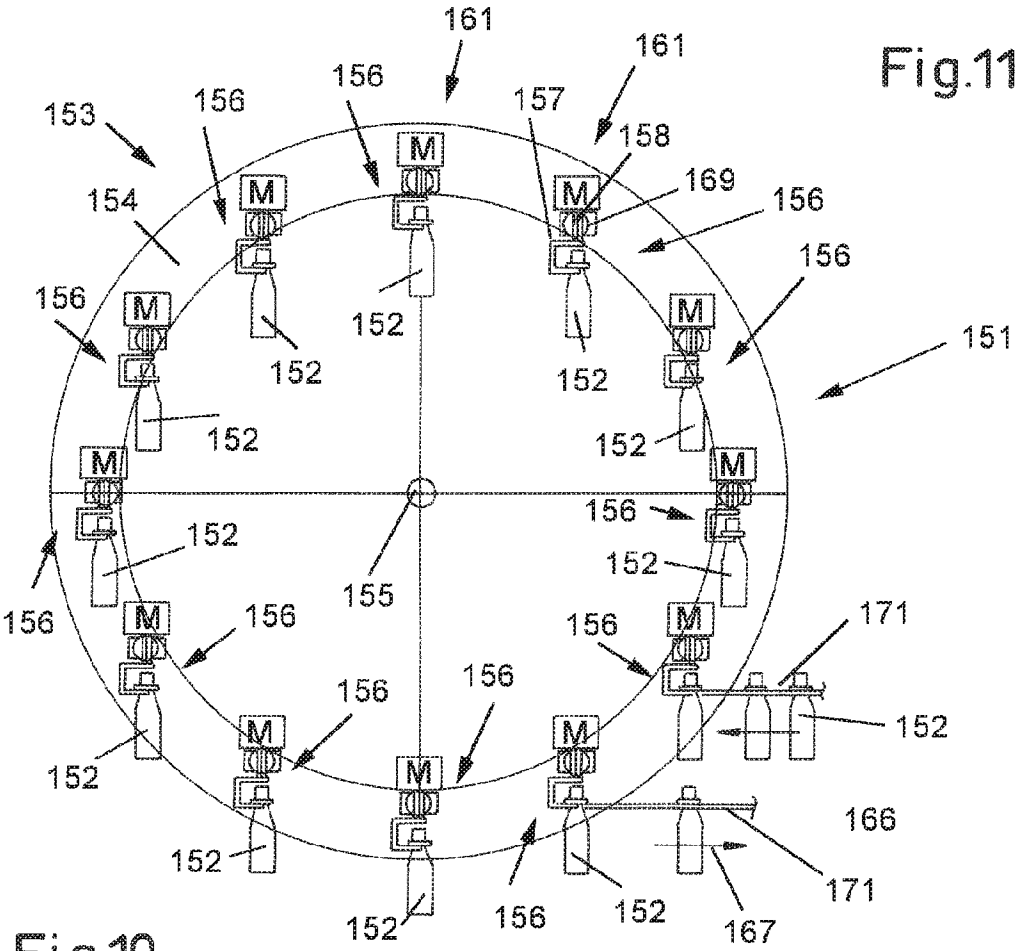
FIG. 10 a cyclically operating printing press according to a further embodiment of the present invention in a side view comparable to FIG. 5.

FIGS. 10 and 11 show a further embodiment of a printing press 151 according to the invention with a vertical clocked wheel 154 as a transport system 153. The axis 155 of the clocked wheel 154 is thus also arranged horizontally in this embodiment of the printing press 151.

At the circumferential edge of the clocked wheel 154, holders 156 are formed for holding respectively a three-dimensional object 152, as FIG. 10 illustrates. Each holder 156 has a receiving frame as a bracket 157 for the three-dimensional object, which can for example be suspended in this receiving frame (bracket 157). The receiving frame (bracket 157) is connected with a motor M via a rotational axis for driving the rotational axis 158.

In addition, similar as with the other holders already described, a centering element may be provided, which engages the object 152 at the opposite end with respect to the receiving frame 157 and holds this in a centering manner.

The receptacle 156 may, in a variant embodiment which is not illustrated, also be formed in the same way as already described with respect to the holders 56, 76 and 96 of the previous embodiments.

By means of the motor M, an object 152 received in the holder 156 can rotate about the rotational axis 158. It is thereby printed in a printing station 161, while the object 152 rotates in front of print heads 160 lying opposite each other. The two print heads 160 of the printing station 161 in the illustration according to FIG. 11 are, as also with all other embodiments of the printing press according to the invention, arranged in such a manner that they lie beyond the interference contour formed by the holder 156 and the object 152 received in the holder 156, which contour results when the clocked wheel 154 rotates about the axis 155.

Instead of printing heads 160, a UV lamp 168 may also be provided in certain printing stations 161 for drying the printing on the object 152 generated by the print heads 160. The object is rotated in front of the UV lamp 168 in the holder 156, similar as in front of a print head 160 for drying the print or for curing the ink.

The print heads 160 and the optionally present UV lamp 168 are, similar to the previous embodiments of the printing presses, fixed to a print head holder 164 in a stationary manner, that is, they do not rotate with the clocked wheel 154. In the illustrated example according to FIG. 11, the print head holder 164 simultaneously serves as a holder for the axis 155 of the clocked wheel. The opposite end of the axis 155 of the clocked wheel 154 is held on a holder 165 lying opposite the print head holder 164.

As shown in FIG. 10, the holders 156 of the three-dimensional objects 152 are always aligned the same in their axial alignment of the rotational axis 158 at all printing stations 161, as well as the input 166 of the three-dimensional object 152 and the output 167 of the three-dimensional object 152. In the illustrated example, the rotational axis 158 is aligned in the direction of gravity, so that the print heads 160 of the printing station 161 print the three-dimensional object 152 from the side (horizontally). In this way, a contamination of the respective other print heads 160 of a printing station is avoided in the described manner.

For this, each holder 156 of the three-dimensional object 152 is held rotatably at the clocked wheel 154 about an axis 169 which runs parallel to the axis 155 of the clocked wheel 154. Thus, the rotational axis 158 of the holder 156 can be aligned the same for each rotational position of the clocked wheel 154 (in particular, each cycled position of the clocked wheel 154). This also enables the input and output of the objects 152 by means of simple linear conveyors.

The holders 156 are held at the clocked wheel 154 via the axis 159 in such a manner that they are themselves rotated in opposite directions during the rotation of the clocked wheel 154 that the rotational axis 158 of the holders 156 are always aligned in the same alignment to each other, thus vertically in the illustrated example. This is also referred to as a Paternoster principle.

For this, a rotary drive 172 is illustrated in FIG. 11, which rotates the axis 169 of the holders 156 in the opposite direction of the timing of the clocked wheel 154 via a sprocket 173 and a gear 174 upon rotation about the axis 155 of the clocked wheel 154. The sprocket 173 thereby engages simultaneously all gears 174 of the axes 169 (see FIG. 10), so that all holders 156 can be aligned simultaneously upon rotation of the clocked wheel 154 by means of the one rotary drive.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 Printing press
2 Three-dimensional object
3 Transport system
4 Clocked wheel
5 Axis of the clocked wheel
6 Holder for holding the three-dimensional object
7 Bracket designed as a disk
8 Rotational axis
9 Centering element
10 Print head
11 Printing station
12 Dotted circle
13 Disturbance contour of holder and object
51 Printing press
52 Three-dimensional object
53 Transport system
54 Clocked wheel
55 Axis of the clocked wheel
56 Holder for holding the three-dimensional object
57 Bracket designed as a disk
58 Rotational axis
59 Centering element
60 Print head
61 Printing station
62 Linkage
64 Print head holder
71 Printing press
73 Transport system
74 Clocked wheel
75 Axis of the clocked wheel
76 Holder for holding the three-dimensional object
77 Bracket designed as a disk
78 Rotational axis
81 Printing station
91 Printing press
92 Three-dimensional object
93 Transport system
94 Clocked wheel
95 Axis of the clocked wheel
96 Holder for holding the three-dimensional object
97 Bracket designed as a disk
98 Rotational axis
99 Centering element
100 Print head
101 Printing station
102 Linkage
104 Print head holder
105 Recess
106 Input of the three-dimensional object
107 Output of the three-dimensional object
108 Input star designed as a rotating wheel rating
109 Star axis
110 Object storage
111 Linear conveyor
112 Feeder
151 Printing press
152 Three-dimensional object
153 Transport system
154 Clocked wheel
155 Axis of the clocked wheel
156 Holder for holding the three-dimensional object
157 Bracket designed as a receiving frame
158 Rotational axis
160 Print head
161 Printing Station
164 Print head holder
165 Holder of the axis of the clocked wheel
166 Input of the three-dimensional object
167 Output of the three-dimensional object
168 UV lamp
169 Axis
171 Linear conveyor
172 Rotary drive
173 Sprocket
174 Gear
M Motor
201 Printing press
202 Clocked wheel
203 Three-dimensional object
204 Print head
205 Printing Station

The invention claimed is:

1. A cyclically operating printing press for printing three-dimensional objects by inkjet printing in at least one printing station, the printing press comprising:

a transport system including a clocked wheel configured to rotate in a clocked manner on which at least one drivable holder for holding a three-dimensional object is arranged;

at least one fixed print head which is not moved with the transport system for inkjet printing in the printing station;

a controller configured to:

position, via the transport system, the holder in the printing station in such a way that the three-dimensional object is held in front of the first print head, and rotate, via the holder, the three-dimensional object held in front of the first print head about an axis of rotation; and at least one additional print head for inkjet printing disposed in the printing station at another location or side than the print head relative to the axis of rotation of the three-dimensional object in such a way that:

dirt emanating from the print head cannot fall down onto any other print head of the printing station as a result of gravity, the at least one additional print head can print the three-dimensional object simultaneously with the at least one print head, and none of the print heads is arranged in an interference contour formed by the holder and the three-dimensional object held therein being moved by the transport system, wherein an axis of the clocked wheel is substantially horizontal and wherein each holder of the three-dimensional object at each printing station always has a same axial orientation and is oriented in each case such that the axis of rotation of the holder is in the direction of gravity, so that the print heads print the three-dimensional object from the side.

2. The printing press according to claim 1, wherein the print heads are arranged opposite each other along a transport route.

3. The printing press according to claim 1, wherein the print heads are arranged in a stationary manner adjacent to the transport system on the left and on the right relative to the transport route.

4. The printing press according to claim 1, wherein the print heads of the printing station are arranged in such a way that a width of a printing format to be produced on the three-dimensional object in the printing station does not exceed a width of the print heads.

5. The printing press according to claim 1, wherein the print heads are configured to print a plurality of colors simultaneously in the printing station.

6. The printing press according to claim 1, wherein each printing station is provided at the transport system with more than one holder for the three-dimensional object, a number of the print heads provided at each printing station corresponding to a number of the holders.

7. The printing press according to claim 1, wherein the holder comprises a bracket with a motor configured to rotate the holder about the axis of rotation and, opposite thereto, a centering element, wherein the three-dimensional object is held and carried on both sides by the bracket and the centering element, respectively, and wherein the centering element is designed and disposed in such a way that it is within the disturbing contour when the transport system and the three-dimensional object move.

8. The printing press according to claim 1, wherein each holder of the three-dimensional object is supported rotatably about an axis at the clocked wheel which is parallel to the axis of the clocked wheel.

9. The printing press according to claim 8, further comprising at least one of an input star and an output star arranged substantially vertically to the clocked wheel to at least one of input and output the three-dimensional object to/from of the clocked wheel.

10. The printing press according to claim 1, wherein an output of the three-dimensional object from the clocked wheel is effected by opening the holder and falling down of the three-dimensional object by gravity.

* * * * *